United States Patent [19]

Stout

[11] 4,217,983

[45] Aug. 19, 1980

[54] ARTICLE CARRIER

[75] Inventor: James T. Stout, Acworth, Ga.

[73] Assignee: The Mead Corporation, Dayton, Ohio

[21] Appl. No.: 25,366

[22] Filed: Mar. 30, 1979

[51] Int. Cl.[3] ..... B65D 75/00

[52] U.S. Cl. ..... 206/187; 229/28 BC; 229/52 BC

[58] Field of Search ..... 206/187, 180, 181–186, 206/188–191; 229/28 BC, 52 BC

[56] References Cited

U.S. PATENT DOCUMENTS

| | | | |
|---|---|---|---|
| 4,000,813 | 1/1977 | Stout | 206/187 |
| 4,010,847 | 3/1977 | Wood et al. | 206/187 |

*Primary Examiner*—Joseph Man-Fu Moy

*Attorney, Agent, or Firm*—Walter M. Rodgers; Walter A. Rodgers

[57] ABSTRACT

An article carrier for the packaging of multiple articles comprises a bottom (2), side walls (1,11) joined to the side edges of the bottom, end wall panels (7,9,12,13) joined to the end edges of the side walls, a pair of medial partition or riser panels (16,17) joined respectively to the end wall panels at one end of the carrier and extending inwardly therefrom, a pair of riser panels (26,27) foldably joined respectively to the end wall panels at the other end of the carrier and extending inwardly therefrom, a multiple ply handle (49,50,51,52) secured to the medial partition panels and the riser panels, and a locking tab (67) foldably joined to one of the handle panels and disposed intermediate the riser panels.

5 Claims, 8 Drawing Figures

Fig. 1
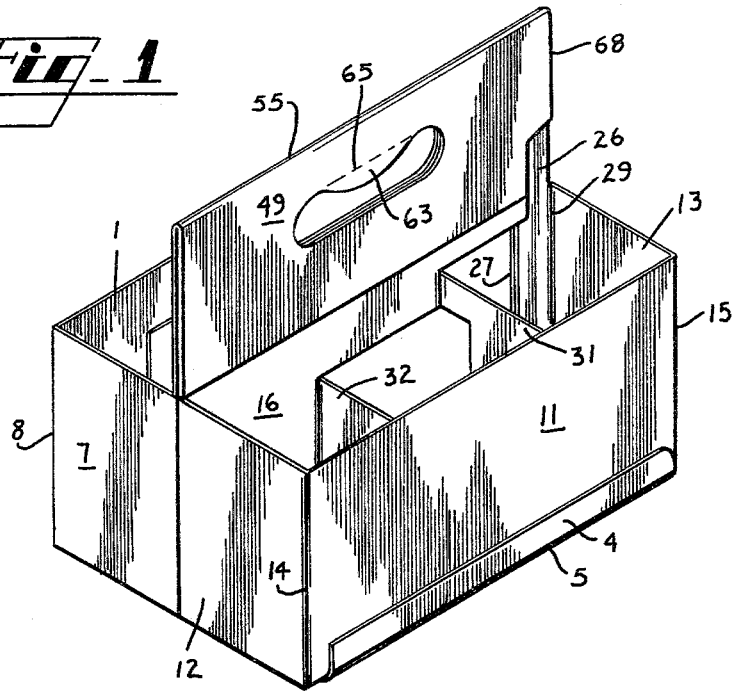
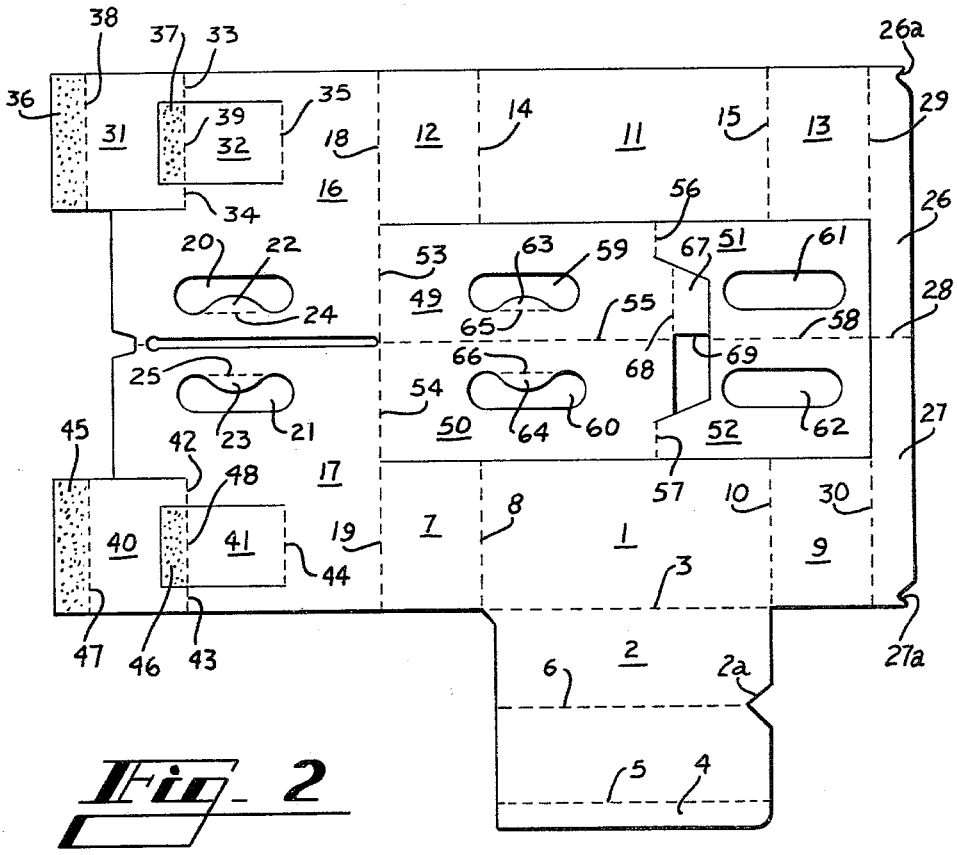
Fig. 2

ARTICLE CARRIER

TECHNICAL FIELD

This invention relates to the packaging of fragile articles such as soft drink and beer bottles in an article carrier which is strong and sturdy and not prone to failure even in the event of inadequate glueing during the manufacturing process.

BACKGROUND ART

Article carriers similar to the present invention are disclosed and claimed in U.S. Pat. Nos. 3,661,297 and 3,349,957, both of which are owned by the assignee of this invention.

DISCLOSURE OF INVENTION

According to this invention an article carrier is provided and comprises a bottom, side and end walls upstanding therefrom, a pair of medial partition or riser panels joined to one end of the carrier and extending inwardly therefrom, a pair of riser panels joined to the other end of the carrier and extending inwardly therefrom, a first pair of handle panels joined respectively to the medial partition or riser panels, a second pair of handle panels joined respectively to the first pair of handle panels along offset fold lines, and a locking tab foldably joined to one of the first pair of handle panels and disposed intermediate and in overlapping relation with the riser panels joined to the other end of the carrier.

BRIEF DESCRIPTION OF DRAWINGS

FIG. 1 is an isometric view of a set-up carrier formed according to this invention;

FIG. 2 is a plan view of a blank from which the carrier shown in FIG. 1 is formed;

BEST MODE FOR CARRYING OUT THE INVENTION

Figure 4:
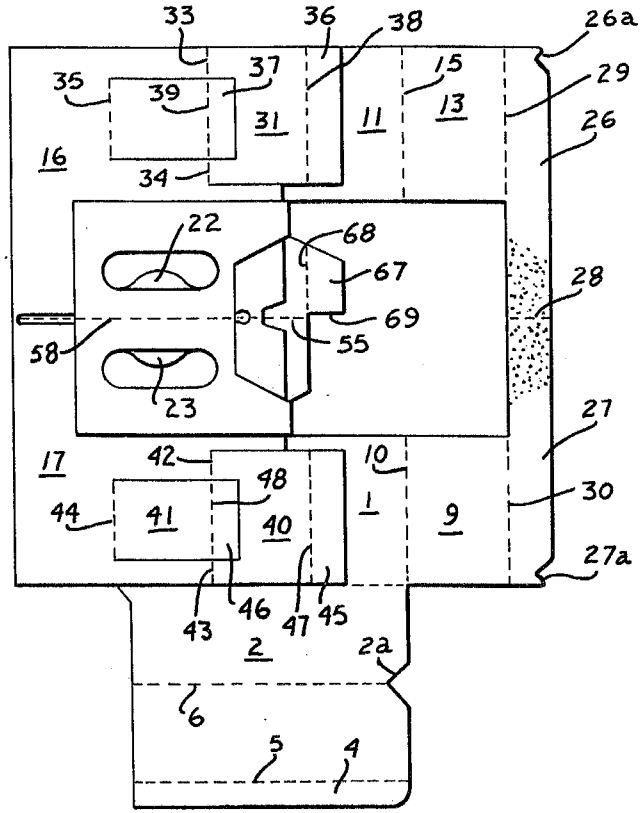
FIGS. 3, 4, 5, 6, and 7 depict intermediate stages through which the blank of FIG. 2 is manipulated and glued in order to form a complete and collapsed carrier as shown in FIG. 8.

In the drawings the numeral 1 designates a side wall of the carrier to the bottom edge of which bottom 2 is foldably joined along fold line 3. Glue flap 4 is foldably joined to bottom 2 along fold line 5 and, additionally, bottom 2 is provided with medial fold line 6 and a notch 2a. End wall panel 7 is foldably joined to an end edge of side wall 1 along fold line 8 and, similarly, end wall panel 9 is foldably joined to the opposite edge of side wall 1 along fold line 10. The opposite side of the blank is similarly formed to that just described and includes side wall 11 to the ends of which end wall panels 12 and 13 are foldably joined respectively along fold lines 14 and 15.

The medial structure for the carrier is formed in part by means of a first pair of medial partition or riser panels 16 and 17. Specifically medial partition panel 16 is foldably joined to end wall panel 12 along fold line 18 and medial partition panel 17 is foldably joined to end wall panel 7 along fold line 19. In addition medial partition panel 16 is provided with hand gripping aperture 20 and, in similar fashion, medial partition panel 17 is provided with hand gripping aperture 21. Also hand cushioning flaps 22 and 23 are foldably joined respectively to medial partition panels 16 and 17 along fold lines 24 and 25. The medial structure at the other end of the blank is formed by means of a second pair of riser panels 26 and 27 which are joined at fold line 28. Also riser panels 26 and 27 are foldably joined respectively to end wall panels 13 and 9 along fold lines 29 and 30 and are provided with locking notches 26a and 27a.

The transverse partition structure on one side of the carrier is formed by transverse partition panels 31 and 32. Specifically transverse partition panel 31 is foldably joined to medial partition panel 16 along fold lines 33 and 34. In similar fashion transverse partition panel 32 is foldably joined to medial partition panel 16 along fold line 35. In order to provide means for securing the transverse partition panels to the associated side walls, anchoring tabs 36 and 37 are foldably joined to transverse partition panels 31 and 32 respectively along fold lines 38 and 39.

The transverse partition structure for the other side of the carrier is similar to that just described and includes transverse partition panels 40 and 41. Transverse partition panel 40 is foldably joined to medial partition panel 17 along fold lines 42 and 43 and transverse partition panel 41 is foldably joined to medial partition panel 17 along fold line 44. In addition anchoring tabs 45 and 46 are foldably joined respectively to transverse partition panels 40 and 41 along fold lines 47 and 48.

In addition to hand gripping apertures 20 and 21, handle structure for the carrier is provided in the form of handle panels 49, 50, 51, and 52. Specifically handle panels 49 and 50 are foldably joined respectively to medial partition panels 16 and 17 along fold lines 53 and 54 and, additionally, are foldably joined to each other along fold line 55. Also handle panels 51 and 52 are foldably joined respectively to handle panels 49 and 50 along fold lines 56 and 57 and are foldably joined together along fold line 58. As best viewed in FIG. 2, fold lines 56 and 57 are offset from the associated end edges of handle panels 49 and 50.

To provide means for carrying the carrier, hand gripping apertures 59, 60, 61, and 62 are formed respectively in handle panels 49 and 50, 51 and 52. In addition hand gripping apertures 59 and 60 are provided respectively with hand cushioning flaps 63 and 64 which are foldably joined respectively to handle panels 49 and 50 along fold lines 65 and 66.

According to this invention the carrier is provided with locking tab 67 which is foldably joined to handle panel 49 along fold line 68. Also locking tab 67 is provided with positioning edge 69.

In order to form the completed carrier from the blank shown in FIG. 2, initially an application of glue is made to anchoring tabs 36, 37, 45, and 46 as shown by stippling in FIG. 2. Following this medial panels 16 and 17 and the associated transverse partition structure in the form of transverse partition panels 31, 32, 40, and 41 as well as anchoring tabs 36, 37, 45 and 46 are all elevated and folded over to the right along fold lines 18, 19, 53, and 54. By this operation anchoring tabs 36 and 37 are adhered to the inner surface of side wall 11 and, similarly, anchoring tabs 45 and 46 are adhered to the inner surface of side wall 1.

Figure 3:
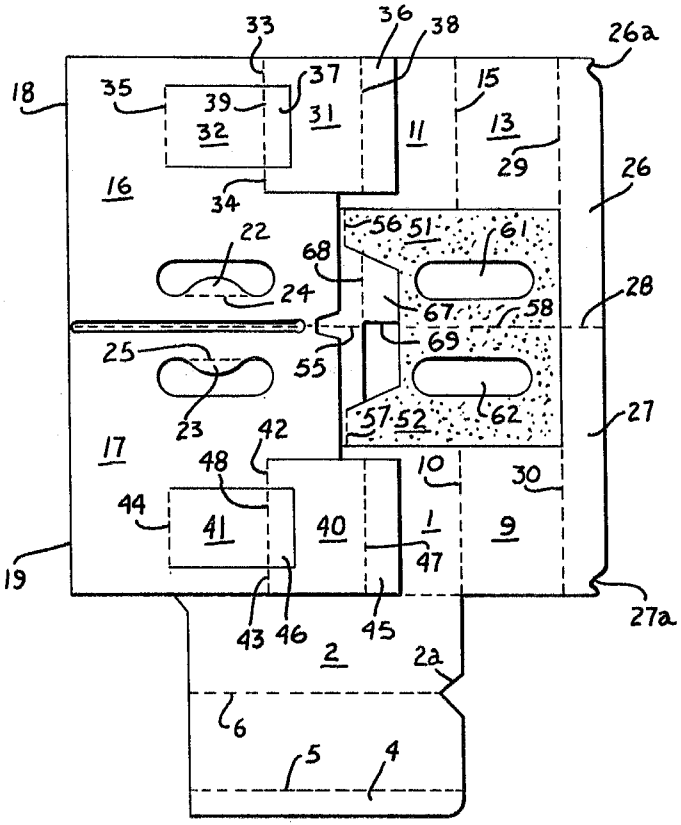

Following this operation an application of glue is made to handle panels 51 and 52 as shown by stippling in FIG. 3. Thereafter handle panels 51 and 52 are elevated and folded over to the left respectively along fold lines 56 and 57 to occupy the positions shown in FIG. 4. As an alternative, handle panels 51 and 52 can be folded prior to the folding of medial partition panels 16 and 17 and the associated transverse partition structure without impairing the structural integrity of the carrier.

Figure 5:
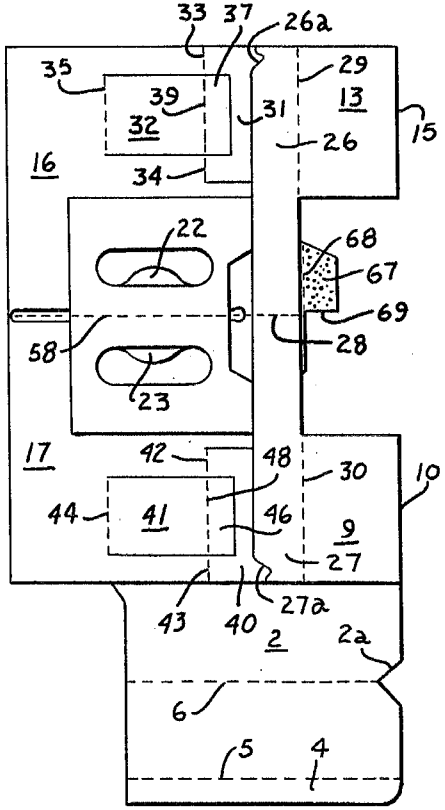

Subsequent to this, glue is applied to riser panels 26 and 27 as shown by stippling in FIG. 4 and then end wall panels 9 and 13 together with riser panels 26 and 27 are elevated and folded over to the left along fold lines 10 and 15 to occupy the positions shown in FIG. 5.

Then an application of glue is made to locking tab 67 as shown by stippling in FIG. 5. According to one aspect of this invention, locking tab 67 is folded over to the left along fold line 68 into flat face contacting relation with a portion of riser panel 26.

Figure 7:
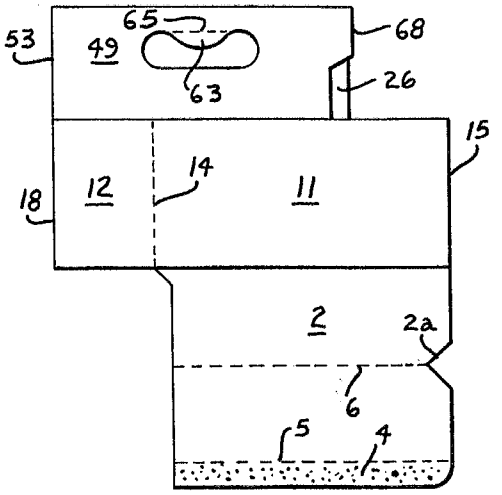
Figure 6:
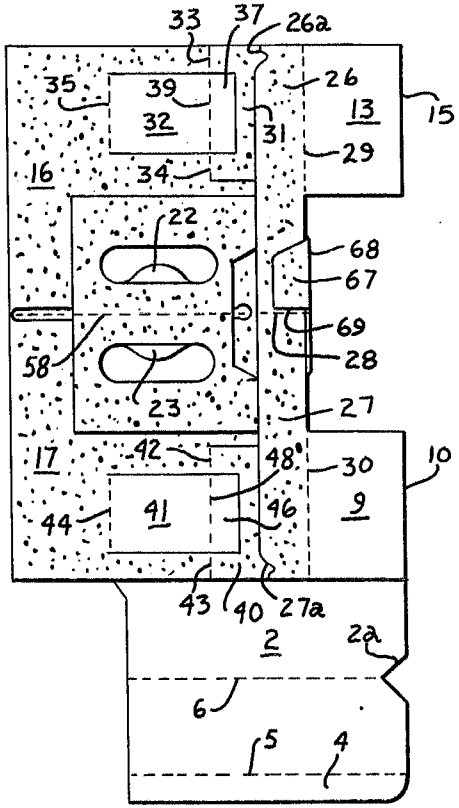

To complete the carrier glue is applied thereto as indicated by stippling in FIG. 6 and then the upper portion of the carrier is elevated and folded over into the position shown in FIG. 7. Then an application of glue is made to glue flap 4 as shown by stippling in FIG. 7. Thereafter bottom wall 2 is folded along medial fold line 6 whereby glue flap 4 is adhered to the lower portion of side wall 11. The carrier than appears as shown in FIG. 8.

Figure 8:
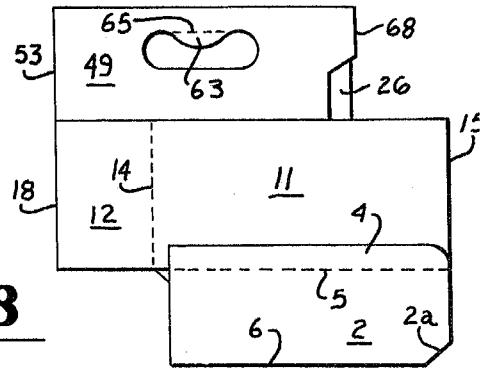

In order to set up the carrier from its collapsed condition as shown in FIG. 8 into the condition shown in FIG. 1, it is simply necessary to secure side walls 1 and 11 against movement toward the right and to apply force toward the right to the medial edges of end wall panels 7 and 12. This expands the carrier and moves the side walls apart. Simultaneously the bottom 2 is folded into a flat plane. The carrier is then maintained in set up condition, as shown in FIG. 1, by cooperation between the locking notches **26*a* and 27*a* and notch 2*a* of bottom 2**.

Therefore by this invention a carrier of enhanced structural integrity is provided because the riser panels 26 and 27 are in effect trapped and interlocked between locking tab 67 and handle panel 49. Therefore if any inadequate glueing of riser panels 26 and 27 to the handle structure occurs, the carrier will not fail since the riser panels 26 and 27 are prevented from movement out of their proper relative positions in the completed carrier.

Although the riser panels are shown in a narrow configuration, this invention is not so limited as the riser panels could be substantially wider than shown in the drawings without deviating from the spirit and scope of this invention. Also the medial partition panels 16 and 17 at the other end of the carrier could be replaced by riser panels similar to elements 26 and 27 if other carrier partition means, such as transverse straps or glued-in partition inserts, is used, as is known in the art.

According to another feature of this invention, after locking tab 67 is folded over along fold line 68, positioning edge 69 is in general coincidence with fold line 55. As the carrier is subsequently manipulated and glued, skewing of the carrier blank around fold line 55 is reduced since positioning edge 69 acts as a reinforcing guide element in the area of handle panels 49 and 50.

INDUSTRIAL APPLICABILITY

By this invention an article carrier is provided in which the riser panels are prevented from slipping out of their proper relative positions in situations such as when they are inadequately glued to the handle panels and, additionally, undesirable skewing of the blank during formation of the carrier is reduced.

I claim:

1. An article carrier comprising a bottom (2), side walls (1,11) foldably joined respectively to the side edges of said bottom, end wall panels (7,9,12,13) foldably joined respectively to the end edges of said side walls and extending inwardly of the carrier, a first pair of riser panels (16,17) foldably joined respectively to said end wall panels at one end of the carrier and extending medially inward of the carrier, a second pair of riser panels (26,27) foldably joined respectively to said end wall panels at the other end of the carrier and extending medially inward of the carrier, a first pair of handle panels (49,50) foldably joined respectively to said first pair of riser panels, a second pair of handle panels (51,52) foldably joined respectively to said first pair of handle panels along fold lines (56,57) offset inwardly from the associated end edges of said first pair of handle panels, and characterized in that a locking tab (67) is foldably joined to said associated end edge of one of said first pair of handle panels and disposed intermediate and in overlapping interlocked relation with said second pair of riser panels.

2. An article carrier according to claim 1 and further characterized in that the upper positioning edge (69) of said locking tab is disposed in substantial coincidence with the upper edges of said first pair of handle panels.

3. An article carrier according to claim 1 and further characterized in that said first pair of riser panels are extended to form medial partition panels and a pair of transverse partition panels (31,32,40,41) are foldably joined respectively to said medial partition panels and secured respectively to said side walls.

4. An article carrier according to claim 3 and further characterized in that a pair of hand gripping apertures (20,21) are formed respectively in said medial partition panels.

5. An article carrier comprising a bottom (2), side walls (1,11) foldably joined respectively to the side edges of said bottom, end wall panels (7,9,12,13) foldably joined respectively to the end edges of said side walls and extending inwardly therefrom, a first pair of riser panels (16,17) foldably joined respectively to said end wall panels at one end of the carrier and extending medially inward of the carrier, a second pair of riser panels (26,27) foldably joined respectively to said end wall panels at the other end of the carrier and extending medially inward of the carrier, a first pair of handle panels (49,50) foldably joined respectively to said first pair of riser panels, a second pair of handle panels (51,52) joined to the end edges of said first pair of handle panels and folded into face contacting relation with said first pair of handle panels, and characterized in that a locking tab (67) is struck from said second pair of handle panels and foldably joined to the end edge of said first pair of handle panels and said locking tab is disposed in overlapping interlocked relation with said second pair of riser panels.

* * * * *